United States Patent [19]

Lesquir

[11] Patent Number: 5,027,969

[45] Date of Patent: Jul. 2, 1991

[54] CLOSURE AND CONTAINER COMBINATION

[75] Inventor: Dominique Lesquir, Buckland, Canada

[73] Assignee: IPL Inc., Bellechasse, Canada

[21] Appl. No.: 547,176

[22] Filed: Jul. 3, 1990

[51] Int. Cl.[5] ..... B65D 17/28

[52] U.S. Cl. ..... 220/270; 220/265; 220/266; 220/306

[58] Field of Search ..... 220/265, 266, 306, 270; 215/250, 253

[56] References Cited

U.S. PATENT DOCUMENTS

| | | | |
|---|---|---|---|
| 4,296,871 | 10/1981 | Andersson | 220/306 |
| 4,422,559 | 12/1983 | Landis | 220/306 |
| 4,560,082 | 12/1985 | Sutch | 220/270 |
| 4,711,364 | 12/1987 | Letica | 220/276 |
| 4,763,732 | 8/1988 | Neal | 169/51 |
| 4,819,824 | 4/1989 | Longbottom et al. | 220/266 |
| 4,821,910 | 4/1989 | Poirier | 220/266 |

*Primary Examiner*—Stephen Marcus
*Assistant Examiner*—Stephen K. Cronin
*Attorney, Agent, or Firm*—Longacre & White

[57] ABSTRACT

The invention relates to the combination of a closure and of a container, the closure displaying a peripheral depending skirt while the container displays, along the walls thereof, a continuous peripheral flange receiving, on the top face thereof, the lower edge of the closure skirt. The connection of the flange at each corner is weakened by the presence of a series of gaps to render the flange at those areas breakable to thereby provide a visual indication of removal of the closure, whether it be authorized or unauthorized.

6 Claims, 3 Drawing Sheets

CLOSURE AND CONTAINER COMBINATION

FIELD OF THE INVENTION

The present invention pertains to the combination of a closure and container of the type providing some indication when unauthorized opening of the closure has occurred.

BACKGROUND OF THE INVENTION

There are contents which, when enclosed in a closure-covered container, must not be tampered with and, when tampering does occur, it is important that those authorized to remove the closure be aware that prior removal of the container has, in fact, occurred. One example of such closure-container combination is found described in applicant's prior issued U.S. Pat. No. 4,821,910. This patent describes the presence of a breakable element as an addition on a peripheral skirt of the closure which, when broken, upon closure removal, will provide a visual indication of such removal.

OBJECTS AND STATEMENT OF THE INVENTION

It is an object of the present invention to provide a novel combination of a closure and container which will provide a visual indication of removal of the closure, which is particularly useful in cases of unauthorized opening.

This is achieved by providing a flange peripherally extending along the container, with weakened portions, preferrably at each corner, which will break upon removal of the closure from the container.

The present invention therefore relates to the combination of:

a closure having a top wall and a peripheral depending skirt; and a container consisting of a body having a bottom wall and side walls joined with rounded corners; the side walls and corners displaying a continuous peripheral flange including a horizontal portion projecting outwardly from the walls and corners; the horizontal portion receiving in close relationship thereover the lower edge of the skirt of the closure; the flange being integrally connected to the walls and corners; gap means being provided in the connection of the flange at each corner to weaken and render breakable the corner connections to thereby provide visual indication of removal of the closure, whether authorized or unauthorized.

In one preferred form of the invention, additional gap means are provided between the flanges at the corners and their adjacent flanges extending from the container side walls.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENT

Figure 1:
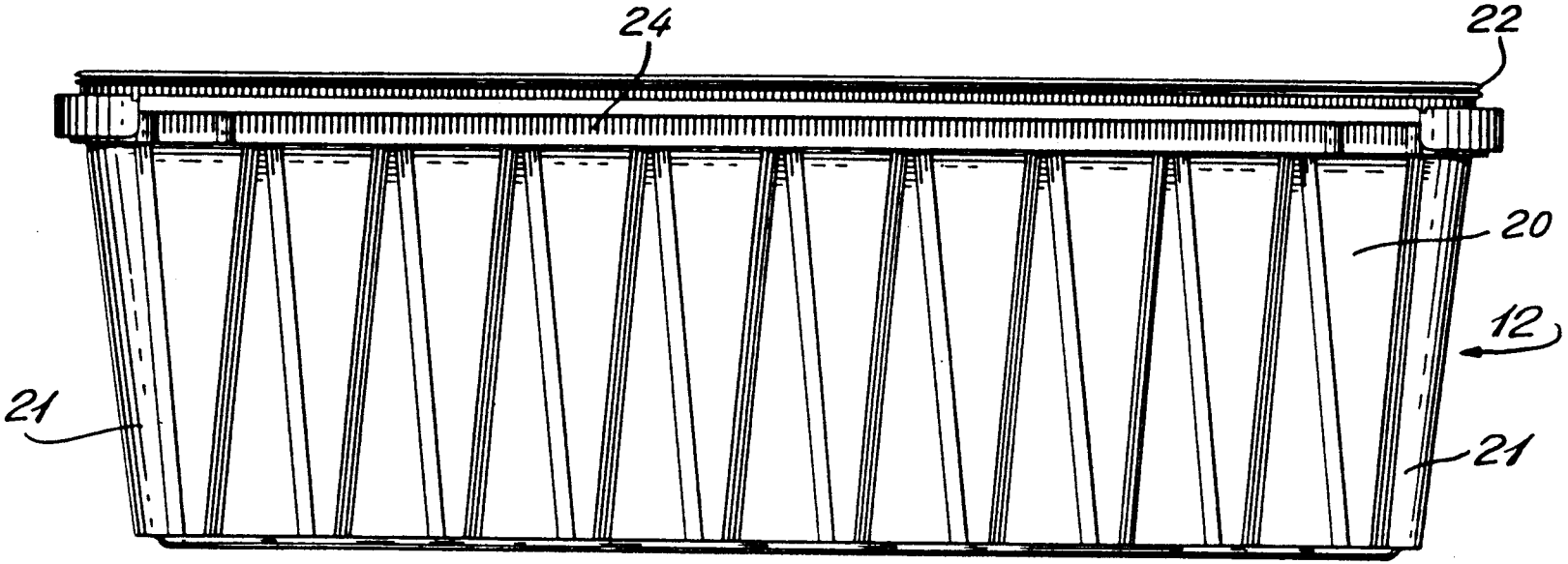
FIG. 1 is a side elevational view of the container of the combination made in accordance with the present invention.
Figure 3:
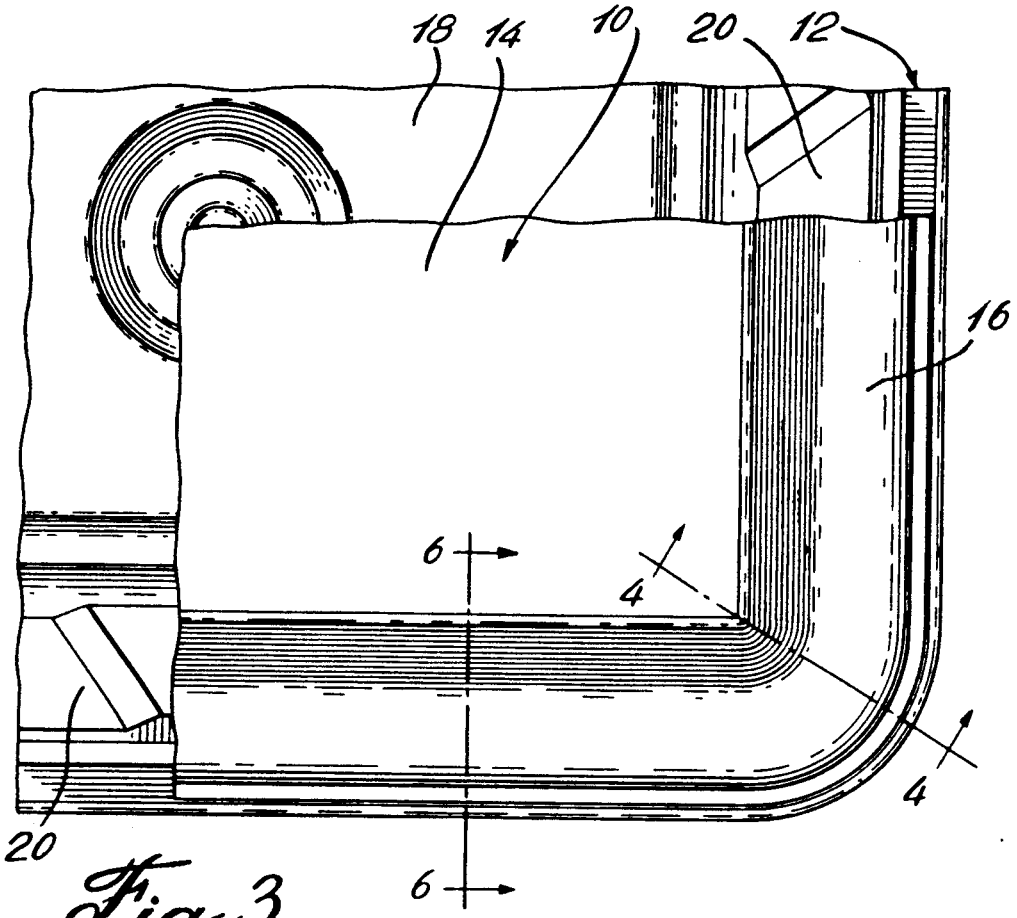
FIG. 3 is a top plan view of the corner area shown in FIG. 2.
Figure 2:
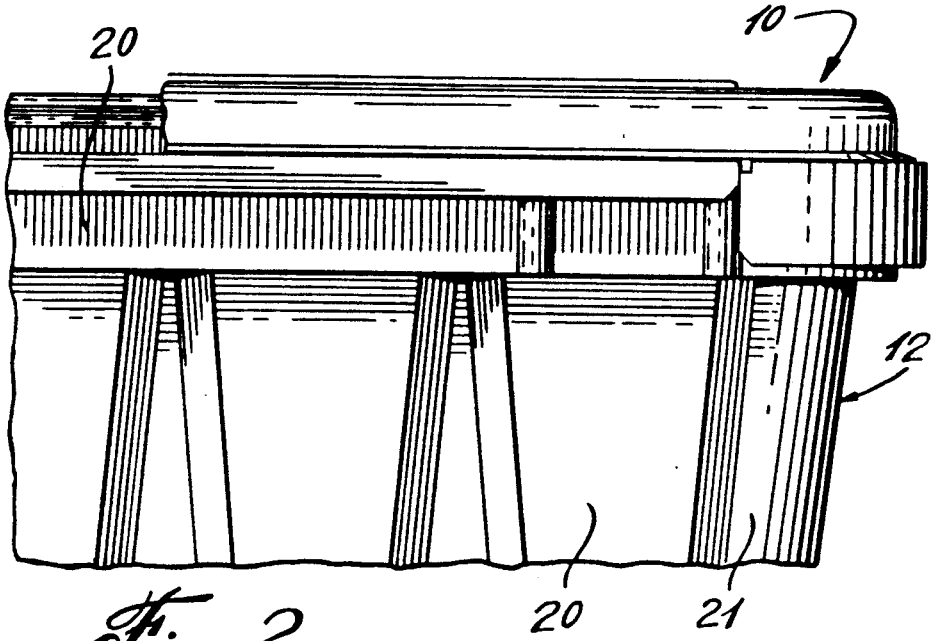
FIG. 2 is an enlarged view of one corner area of the closure and container combination of the present invention.

Referring to FIG. 1, there is shown a container, generally denoted 12, which is adapted to receive, in covering arrangement, a closure, generally denoted 10, part of which is shown in FIGS. 2 and 3.

The closure 10 comprises a flat top wall 14 with an integral peripheral edge portion 16.

The container 12 comprises a rectangular body having a bottom wall !8 and four sloping side walls 20 which are joined with rounded corners 21 and which display, slightly below its upper edge 22, a peripheral outwardly projecting flange, generally denoted 24.

Figure 5:
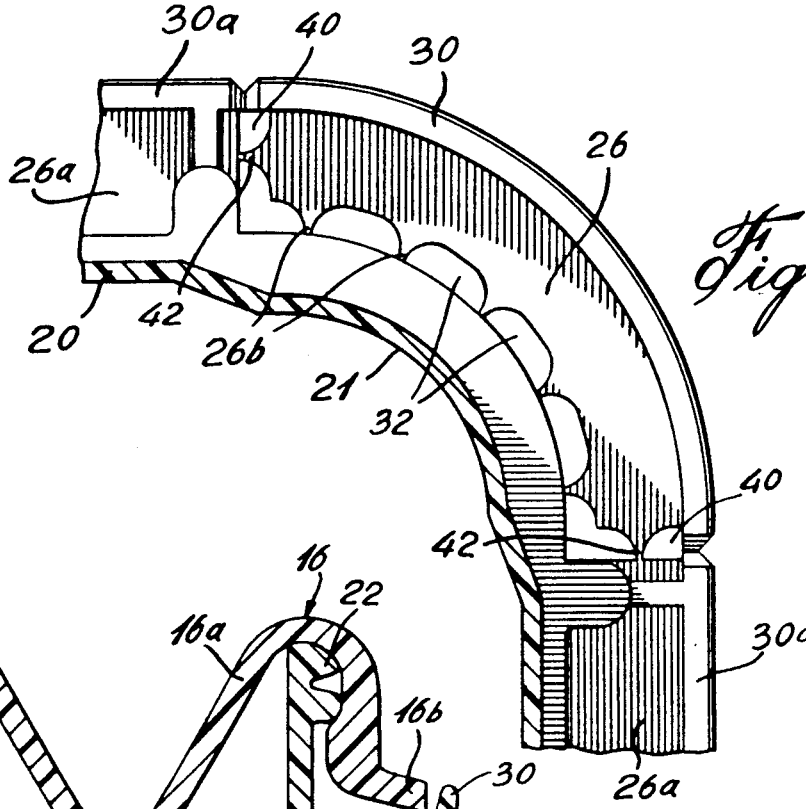
FIG. 5 is a cross-sectional view taken along lines 5—5 of FIG. 4.
Figure 4:
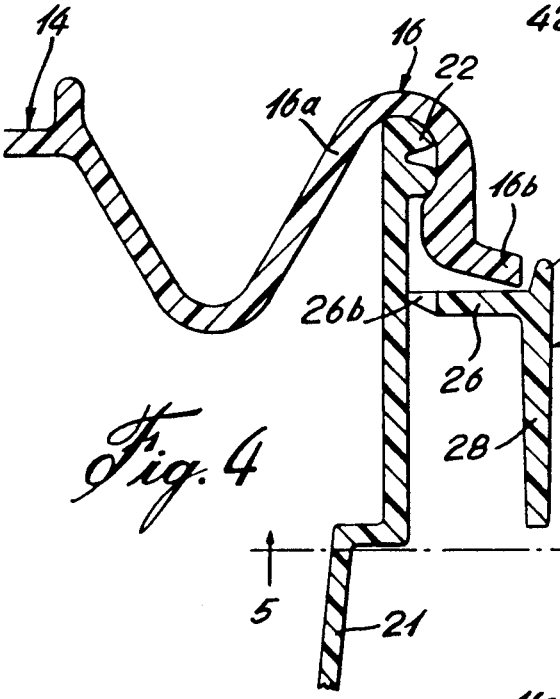
FIG. 4 is a cross-sectional view taken along lines 4—4 of FIG. 3.
Figure 6:
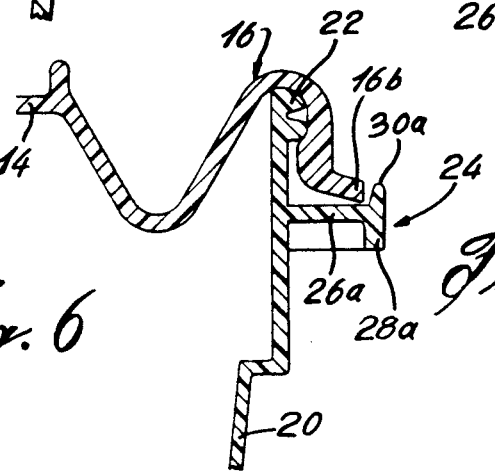
FIG. 6 is a cross-sectional view taken along lines 6—6 of FIG. 3.

Comparing FIG. 4 to FIG. 6, the peripheral flange 24 differs somewhat in construction at the corners (FIG. 4) than along each side wall (FIG. 6). At each corner, the flange comprises a horizontal portion 26 and a vertical portion 28 displaying an upper lip 30; along each side wall, the flange comprises a horizontal portion **26*a* and a vertical portion 28*a* displaying an upper lip 30*a*. The horizontal portion 26*a* is of uniform thickness while the vertical portion 28*a*** is of reduced height.

The present invention is concerned with providing weakened areas in the corner flanges of the container. Referring to FIGS. 4 and 5, the connection of flange 26 with corner wall 21 of the container displays a series of gaps or openings 32 thereby weakening the connection between the flanges and the container. Further, the connection is further weakened by reducing the cross-sectional area of the flange at its connection **26*b*** with the corner wall.

The peripheral edge portion 16 of the closure has an inverted U-shape defining a skirt with lower extremity **16*b* which, when the closure is tightly secured over the upper edge 22 of the container, is located rearwardly of the upper lip(30, 30*a*) over the peripheral flange (26, 26*a*). As it can be seen in FIG. 4, the inner wall of the U-shaped configuration of the edge portion 16 is such as to provide a tight engagement with the upper edge 22** of the container when the closure is on the container.

Figure 7:
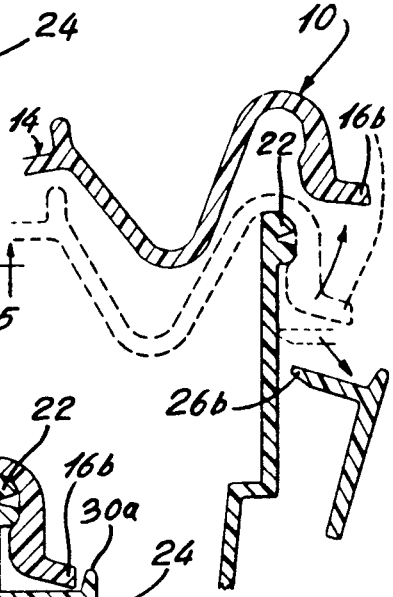
FIG. 7 is a view similar to FIG. 4 showing separation of the closure from the container.

Referring to FIG. 7, when the closure 10 is removed, manually or with the assistance of a tool, the lower edge **16*b* of the skirt can only be reached by downwardly pressing the flange 24. This will result in breaking the weakened connecting areas 26*b*** thus providing indication that the closure has been manipulated.

In a preferred embodiment, the connection of the flange portion 26, at each corner, with the flange portion **26*a* along adjacent side walls is also provided with gaps 40 leaving small connecting areas 42 between adjacent flange portions. Although not shown, these connecting areas 42 may have a reduced cross-section similar to that of connecting areas 26***b*.

The container and closure are unitary bodies formed of injection molded plastic material.

Although the invention has been described above in relation to one specific form, it will be evident to a person skilled in the art that it may be refined and modified in various ways. It is therefore wished to have it understood that the present invention should not be limited in interpretation, except by the terms of the following claims.

The embodiments of the invention in which an exclusive property or privilege is claimed are defined as follows:

1. In combination, a closure and a container;

said closure having a top wall and a peripheral depending skirt having a lower edge;

said container consisting of a body having a bottom wall and more than one flat side wall joined with rounded corners; said side walls and corners displaying a continuous peripheral flange including a horizontal portion projecting outwardly from said walls and corners; said horizontal portion receiving, in close relationship thereover, said lower edge of said skirt of said closure; said flange being integrally connected to said walls and corners; gap means in the connection of said flange at each said corner to weaken and render breakable the corner connections to thereby provide visual indication of removal of said closure, whether authorized or unauthorized.

2. A combination as defined in claim 1, further comprising gap means in the connection of said horizontal portion of said flange at said corners with contiguous horizontal portions of said flange at said side walls to thereby weaken the connection between the corner and side wall horizontal flange portions.

3. A combination as defined in claim 1 or claim 2, wherein all said connections have a reduced cross section compared with the cross section of said horizontal portions.

4. A combination as defined in claim 1, wherein said skirt of said closure displays an inverted U-shaped configuration adapted to engage upper edges of said side walls and said corners.

5. A combination as defined in claim 1, wherein said horizontal portion displays an upper lip at its outmost end thereof; said lower edge of said skirt being received rearwardly of said lip to thereby hinder access to said lower edge.

6. A combination as defined in claim 1, wherein said container is a unitary body made of injection molded plastic material.

* * * * *